US007555978B2

(12) United States Patent
Hiez et al.

(10) Patent No.: US 7,555,978 B2
(45) Date of Patent: Jul. 7, 2009

(54) HYDRAULIC ACTUATING DEVICE

(75) Inventors: Marc Louis Philippe Hiez, Haplincourt (FR); Johnny Antonius Jacobus Wiggemans, Oldenzaal (NL); Laurentius Andreas Gerardus Mentink, Haaksbergen (NL)

(73) Assignee: Actuant Corporation, Butler, WI (US)

( * ) Notice: Subject to any disclaimer, the term of this patent is extended or adjusted under 35 U.S.C. 154(b) by 223 days.

(21) Appl. No.: 11/670,124

(22) Filed: Feb. 1, 2007

(65) Prior Publication Data

US 2007/0180985 A1 Aug. 9, 2007

(30) Foreign Application Priority Data

Feb. 3, 2006 (NL) ..... 1031072

(51) Int. Cl.
*F15B 11/048* (2006.01)
*F15B 15/22* (2006.01)
*F16D 31/02* (2006.01)

(52) U.S. Cl. ..... 91/520; 91/395; 91/396; 60/476

(58) Field of Classification Search ..... 60/476; 91/395, 396, 405, 515, 520
See application file for complete search history.

(56) References Cited

U.S. PATENT DOCUMENTS 3,559,535 A * 2/1971 Conolly ..... 91/396
3,613,503 A 10/1971 Phillips
6,382,075 B1 5/2002 Chiaramonte
6,739,235 B2 * 5/2004 Mentink ..... 91/395
2003/0056507 A1 3/2003 Mentink

FOREIGN PATENT DOCUMENTS

DE 2020512 A1 11/1970
DE 10229992 A1 1/2003
EP 1031697 A 8/2000

OTHER PUBLICATIONS

PCT Search Report dated Sep. 16, 2006 for patent application NL 1031072.

* cited by examiner

*Primary Examiner*—Michael Leslie
(74) *Attorney, Agent, or Firm*—Quarles & Brady LLP

(57) ABSTRACT

Hydraulic actuating device comprising a first and a second hydraulic actuator, which actuators have a first and a second connection for the supply and discharge of hydraulic fluid, which connections are in communication with a first and a second chamber, respectively, by way of a first and a second opening, respectively, in the cylinder space. The first opening of the second hydraulic actuator is in communication with the first opening of the first hydraulic actuator. The second opening of the second hydraulic actuator is in communication with the second opening of the first hydraulic actuator via a third connection. The third connection is in communication with the cylinder space in the first hydraulic actuator via a third opening. Damping means are achieved by a restriction of the outflow of hydraulic fluid via the second opening before the piston/piston rod assembly reaches the second end position.

12 Claims, 2 Drawing Sheets

HYDRAULIC ACTUATING DEVICE

CROSS-REFERENCE TO RELATED APPLICATION

This application claims priority from Netherlands patent application 1031072, filed Feb. 3, 2006.

FIELD OF THE INVENTION

According to a first aspect, the present invention relates to a hydraulic actuating device in accordance with the preamble of claim 1.

BACKGROUND OF THE INVENTION

A hydraulic actuating device according to the preamble of claim 1 is for example known from EP 1 031 697 in the name of the Applicant.

With this known actuating device, the first hydraulic actuator provided with a bypass duct, via which fluid which is supplied to a chamber of the hydraulic actuator can partially or completely flow away if the piston has opened the inlet opening of the bypass duct. The bypass duct produces the effect that the speed of movement of the piston/piston rod assembly is damped before the end position is reached. Also, the force which can be delivered by the hydraulic actuator decreases as soon as fluid which is supplied under pressure to a chamber of the actuator is able to flow away via the bypass duct.

In practice, it happens that damping of the speed of movement of the piston/piston rod assembly is desirable, but that it is a problem that the force that can be delivered by the actuator already decreases before the end position has been reached.

It is an object of the present invention to provide an improved hydraulic actuating device, by means of which, on the one hand, a good damping action can be obtained and, on the other hand, the actuator can continue to deliver a force effectively until it reaches its end position.

SUMMARY OF THE INVENTION

The present invention achieves the abovementioned object by providing a hydraulic actuating device according to the preamble of claim 1, wherein the first opening of the second hydraulic actuator is in communication with the first opening of the first hydraulic actuator, in that the second opening of the second hydraulic actuator is in communication with the second opening of the first hydraulic actuator via a third connection to the housing of the first hydraulic actuator, the third connection being in communication with the cylinder space in the first hydraulic actuator via a third opening, and in that the damping means are achieved by the fact that the piston/piston rod assembly of the first hydraulic actuator is provided with a throttle means, which, during movement of the piston/piston rod assembly from the first to the second end position, is designed to restrict the outflow of hydraulic fluid via the second opening before the piston/piston rod assembly reaches the second end position.

By means of the invention, it is achieved that, when the piston/piston rod assemblies are moved to the second end position, the throttle means goes into operation at a certain point before this end position is reached, as a result of which the speed of movement of the piston/piston rod assemblies is damped. The outflow of hydraulic fluid is for example restricted by the fact that the throttle means bears against the second opening and thus partly covers the second opening. As a result, it is less easy for the fluid from the second chamber to flow out via the second opening.

The throttle means limits the rate at which the hydraulic fluid flows out, so that the movement of the piston/piston rod assemblies is damped near the second end position.

Preferably, the throttle means comprises a throttle element having a throttle groove.

The solution according to the invention is particularly advantageous for a hydraulic actuator with a small diameter, in which very small fluid volumes flow out of the second chamber during the damping action of the actuator. The throttle means comprising a throttle element with throttle groove achieves a stable outflow at small volumes.

In practice, it often happens that a movable part, for example a movable part of a vehicle, such as, for example, a vehicle hood assembly for covering a passenger space of the vehicle, or a boot lid, is essentially simultaneously driven by two hydraulic actuators, disposed on opposite sides of the part in question.

In that situation, the damping action is also present in the case of the second hydraulic actuator without any separate facility being required on the actuator. This is very advantageous technically and from the point of view of cost.

BRIEF DESCRIPTION OF THE DRAWINGS

The invention will be explained in more detail below with reference to the drawing, in which.

DESCRIPTION OF THE PREFERRED EMBODIMENT

Figure 1:
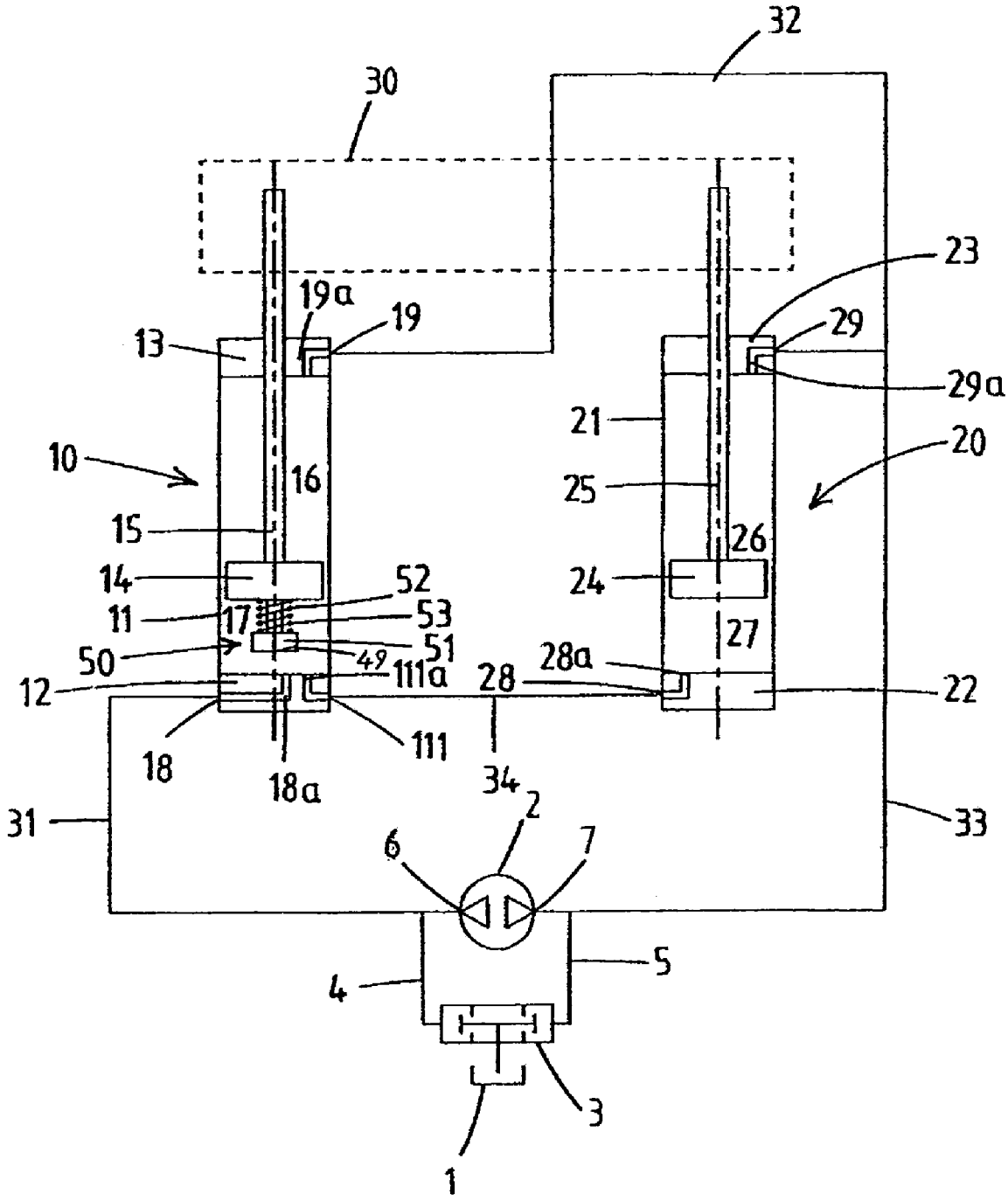
FIG. 1 shows, partly in cross section and partly diagrammatically, an exemplary embodiment of the hydraulic actuating device according to the invention, in which a first hydraulic actuator is provided with damping means.

FIG. 1 shows a hydraulic actuating device with a reservoir 1 for hydraulic fluid and a reversible pump 2, for example an electrically drivable pump.

A suction switch valve 3 is provided, which suction switch valve connections by way of ducts 4, 5 to the ports 6, 7 of the pump 2. The ducts represented diagrammatically are, for example, hoses.

The actuating device furthermore comprises a first hydraulic actuator 10 and a second hydraulic actuator 20. The actuators 10, 20 jointly drive an object 30, which is shown by dashed lines in the figure. For example, the object is the hood of a convertible, a boot lid, a tonneau cover or another movable part of a motor vehicle. Of course, totally different applications are also conceivable.

The first hydraulic actuator 10 is in the form of a linear cylinder and has a substantially tubular housing 11, which is closed off at the axial ends by end pieces 12, 13.

A cylinder space is formed in the housing 11, in which cylinder space a piston/piston rod assembly, with piston 14 and piston rod 15, is accommodated in such a way that it can move axially to and fro between corresponding first and second end positions. The piston 14 rests against end piece 13 in the first end position and against end piece 12 in the second end position.

The piston rod 15 of the piston/piston rod assembly projects out of the housing 11 through the end piece 13.

In the cylinder space, the piston/piston rod assembly bounds a first chamber 16 and a second chamber 17 with a volume that is dependent upon the position of the piston/piston rod assembly, the volume of the first chamber 16 being at its smallest when the piston/piston rod assembly is situated in the first end position, and the volume of the second chamber 17 being at its smallest when the piston/piston rod assembly is situated in the second end position.

The housing 11 is furthermore provided with a first and a second connection 19, 18 for the supply and discharge of hydraulic fluid, which connections are in communication with the first and the second chamber 16, 17 by way of a first and a second opening 19*a*, 18*a*, respectively, in the cylinder space.

The first hydraulic actuator 10 is furthermore provided with damping means for providing a damping of the speed of movement of the piston/piston rod assembly near the second end position.

Said damping means are achieved by the fact that the piston/piston rod assembly 14, 15 is provided with a throttle means 50, which is designed to restrict the second opening 18*a* during reciprocating movement of the piston/piston rod assembly 14, 15 from the first to the second end position before the piston/piston rod assembly reaches the second end position.

In the example shown, the throttle means 50 comprises an annular throttle element 51, which is fitted in an axially slidable manner on an axle 53, which is coaxial with respect to the piston rod 15 of the first actuator 10. The axle 53 is arranged on the side of the piston 14 opposite the side on which the piston rod 15 is arranged.

The throttle means furthermore comprises a spring means 52 which is arranged between the piston 14 and the throttle element 51 and which presses the throttle element 51 away from the piston 14.

In this case, the throttle element 51 has a smaller diameter than the piston 14.

An alternative embodiment is possible, in which the throttle element 51 has a diameter which is identical to that of the piston 14, the hydraulic fluid being able to pass through passages in the throttle element 51. In that case, the wall of the cylinder space can provide guidance for the throttle element 51, so that the axle 53 is superfluous.

On its side facing the piston 14, the end piece 12 of the housing 11 has an opening which is in communication with connection 18 to the second opening 18*a*, against which the throttle element 51 comes to lie with a throttling effect before the second end position is reached when the piston/piston rod assembly is moved from the first to the second end position. In this case, the throttling effect is achieved by the fact that the second opening 18*a* which is in communication with connection 18 is constricted. To this end, a throttle groove 49, in this case a bevelled edge, is provided on the head end of the throttle element 51.

The second hydraulic actuator 20 is of a commonly used design and has a housing 21 with end pieces 22, 23, which bound a cylinder space in the housing 21.

A piston/piston rod assembly with piston 24 and piston rod 25 is accommodated in the cylinder space in such a way that it can move axially to and fro between corresponding first and second end positions. The piston 24 rests against the end piece 23 in the first end position and against the end piece 22 in the second end position.

The piston rod 25 projects out of the housing 21 through the end piece 23.

In the cylinder space, the piston/piston rod assembly 24, 25 bounds a first chamber 26 and second chamber 27, which chambers have a volume that depends on the position of the piston/piston rod assembly 24, 25, the volume of the first chamber being at its smallest when the piston/piston rod assembly is in the first end position, and the volume of the second chamber being at its smallest when the piston/piston rod assembly is in the second end position.

The housing 21 is provided with a first and a second connection 29, 28 for the supply and discharge of hydraulic fluid, which connections are in communication with the first and the second chamber 26, 27 by way of a first and a second opening 29*a*, 28*a*, respectively, in the cylinder space.

The housing 11 of the first hydraulic actuator 10 is provided with a third connection 111 which is in communication with the second chamber 17 in the cylinder space via a third opening 111*a*. The third opening 111*a* is in communication with the chamber inside which the damping means are situated.

The first opening 29*a* of the second hydraulic actuator 20 is in open communication with the first opening 19*a* of the first hydraulic actuator 10 by way of a duct 32.

The second opening 28*a* of the second hydraulic actuator 20 is in open communication with the third opening 111*a* of the first hydraulic actuator 10 by way of a duct 34. The third opening 111*a* of the first hydraulic actuator is in open communication with the second opening 18*a* of the first hydraulic actuator via the chamber 17. A duct 17, which is connected to the port 6 of the pump 2 and the connection 18, is thus in open communication with the second opening 28*a* of the second hydraulic actuator 20.

In the case of the actuating device described, the following effect is obtained. When hydraulic fluid is supplied under pressure by way of the port 7 of the pump 2 to the first connections 19, 29 of both the first and the second hydraulic actuator 10, 20, the result is that the piston/piston rod assemblies 14, 15 and 24, 25 of said actuators move from the first end position to the second end position.

So long as the throttle means 50 is not yet in operation, fluid flows out of the second chambers 27 and 17 essentially unimpeded by way of the ducts 31 and 34 to the port 6 of the pump.

At a certain point, still before the second end position is reached, the throttle means 50 goes into operation due to the fact that the throttle element 51 comes to lie against the end piece 12. From that point onwards, the second opening 18*a* is partially sealed off from the cylinder space, and less fluid can flow away by way of the second connection 18.

In this way, with a single throttle means 50 an identical damping action is obtained for both actuators 10, 20, in which case only the actuator 10 is then provided with the throttle means 50 described earlier.

Figure 2:
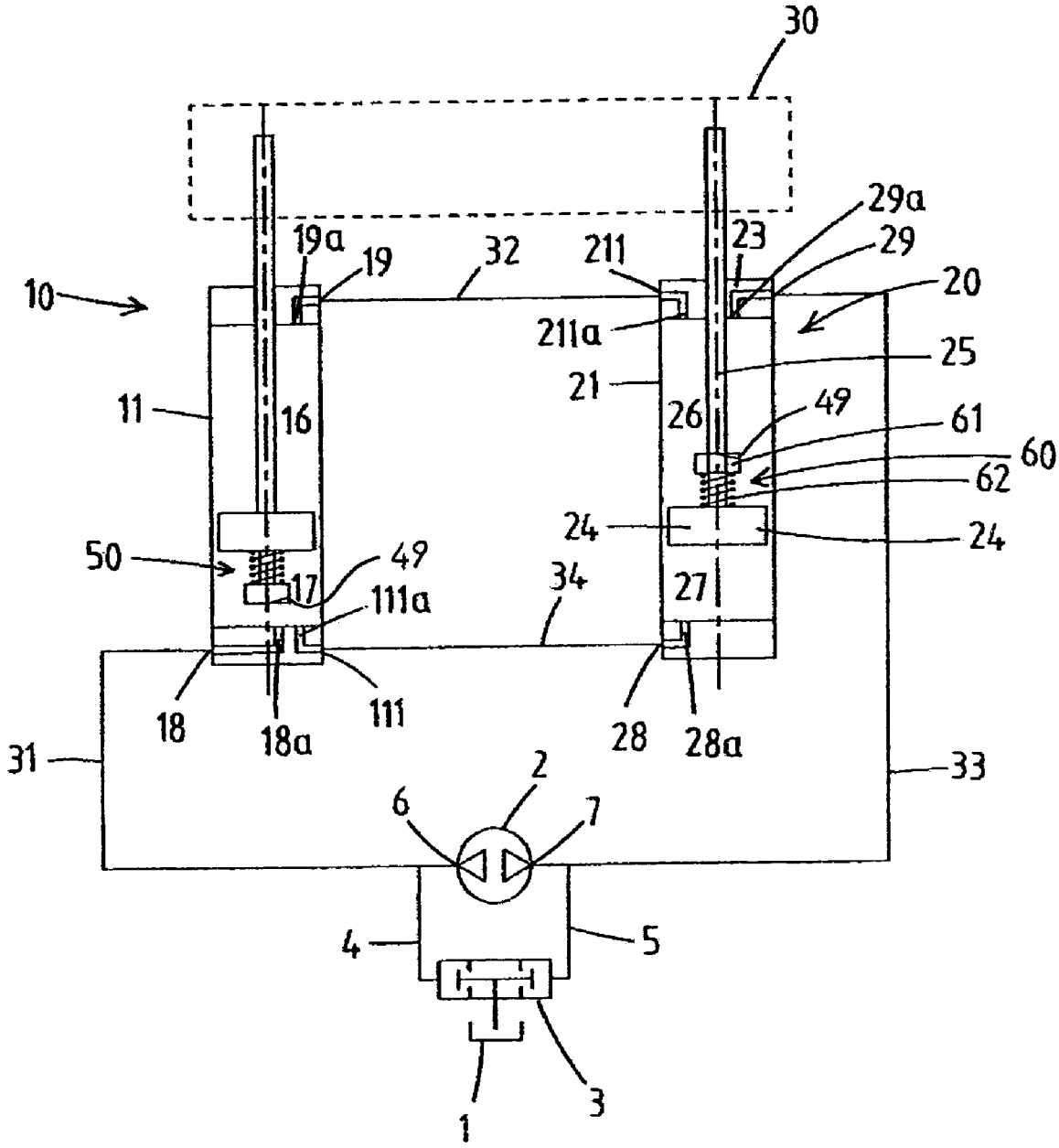
FIG. 2 shows, partly in cross section and partly diagrammatically, an exemplary embodiment of the hydraulic actuating device as in FIG. 1, in which a second hydraulic actuator is also provided with damping means.

The configuration of the hydraulic actuating device illustrated in FIG. 2 is largely identical to the configuration as illustrated in FIG. 1. FIG. 2 shows a hydraulic actuating device with a reservoir 1 for hydraulic fluid and a reversible pump 2.

A suction switch valve 3 is provided, which suction switch valve connects by way of ducts 4, 5 to the ports 6, 7 of the pump 2.

The actuating device furthermore comprises a first hydraulic actuator 10 and a second hydraulic actuator 20. The actuators 10, 20 jointly drive an object 30, which is shown by dashed lines in the figure.

Inside the cylinder space of the first hydraulic actuator 10, two chambers 16, 17 can be seen which are in communication with the chambers 26, 27 which can be seen inside the cylinder space of the second actuator 20 by means of the ducts 32, 34, respectively. The first hydraulic actuator 10 in FIG. 2 has the same configuration as the first hydraulic actuator 10 in FIG. 1. The second hydraulic actuator 20 in FIG. 2 is different and comprises damping means to achieve damping of the speed of movement of the piston/piston rod assemblies near the first end position.

The housings 11, 21 of the first and second hydraulic actuator 10, 20 are provided with a third connection 111, 211 which are in communication with the second chamber 17 and the first chamber 26, respectively, in the cylinder spaces via a third opening 111*a*, 211*a*. The third openings 111*a*, 211*a* are in communication with the chamber in which the damping means are situated.

The first opening 19*a* of the first hydraulic actuator 10 is in open communication with the third opening 211*a* of the second hydraulic actuator 20 by way of a duct 32.

The second opening 28*a* of the second hydraulic actuator 20 is in open communication with the third opening 111*a* of the first hydraulic actuator 10 by way of a duct 34. The third opening 111*a* of the first hydraulic actuator is in open communication with the second opening 18*a* of the first hydraulic actuator via the chamber 17. A duct 31 which is connected to the port 6 of the pump 2 and the connection 18 is thus in open communication with the second opening 28*a* of the second hydraulic actuator 20.

The damping means for the first end position are achieved by the fact that the piston/piston rod assembly 24, 25 is provided with a throttle means 60, which is designed to restrict the first opening 29*a* during movement of the piston/piston rod assembly 24, 25 from the second to the first end position before the piston/piston rod assembly reaches the first end position.

In FIG. 2, the throttle means 60 comprises an annular throttle element 61, which is fitted in an axially slidable manner on the piston rod 25 of the second actuator 20 and is guided on this piston rod 25.

The throttle element 61 has a smaller diameter than the piston 24.

The throttle means furthermore comprises a spring means 62, which is disposed between the piston 24 and the throttle element 61 and presses the throttle element 61 away from the piston 24.

The end piece 23 of the housing 21, on its side facing the piston 24, has a first opening 29*a*, which is in communication with the connection 29. When the piston/piston rod assembly movement is moved from the second to the first end position, the annular throttle element 61 comes to lie against the first opening 29*a* before the first end position has been reached. As a result, the opening becomes smaller, so that the hydraulic fluid from the chambers 16, 26 encounters increased resistance when it flows away via the connection 29 of the second hydraulic actuator 20. The increased resistance causes a throttling effect, so that the speed of movement of the piston/piston rod assemblies of the various actuators decreases.

The configuration shown in FIG. 2 produces the effect that a damping action is obtained both for the first end position and for the second end position before the piston/piston rod assembly reaches the end position. During the last part of the displacement to the end position, the opening, i.e. the active passage, is reduced to form a throttle opening.

The advantage of the illustrated configuration, in which two actuators comprise not more than one throttle means, is that the hydraulic actuators, which are in communication with one another, have a substantially identical installation length. This simplifies the design and is convenient for maintenance activities. In a variant of the embodiment as illustrated in FIG. 2, it is possible to design one of the hydraulic actuators connected in series with a double damping for both end positions. To this end, a throttle means is provided on both sides of the piston.

Many variants are possible in addition to the embodiments illustrated in the figures. In one variant, several, for example four, additional actuators can be damped using a single specially adapted first actuator. Likewise, it is possible to damp only the outward stroke, the displacement from the second to the first end position, in a manner according to the invention.

Thus, an improved hydraulic actuating device with a good damping action is provided according to the invention. With the solution described above, the maximum force which can be delivered is fully retained during the extension of the piston/piston rod assemblies 14, 15 and 24, 25. The maximum force that can be delivered by the actuators 10, 20 is also fully available during the retraction of the piston/piston rod assemblies.

We claim:

1. Hydraulic actuating device comprising:

a first hydraulic actuator, which actuator has a housing containing a cylinder space in which a piston/piston rod assembly is accommodated in such a way that it can move axially to and fro between corresponding first and second end positions, which piston/piston rod assembly projects out of the housing, in which, in the cylinder space, the piston/piston rod assembly bounds a first chamber and second chamber, which chambers have a volume that depends on the position of the piston/piston rod assembly, the volume of the first chamber being at its smallest when the piston/piston rod assembly is situated in the first end position, and the volume of the second chamber being at its smallest when the piston/piston rod assembly is situated in the second end position, in which the housing is provided with a first and a second connection for the supply and discharge of hydraulic fluid, which connections are in communication with the first and the second chamber, respectively, by way of a first and a second opening, respectively, in the cylinder space, a second hydraulic actuator, which second actuator has a housing containing a cylinder space in which a piston/piston rod assembly is accommodated in such a way that it can move axially to and fro between corresponding first and second end positions, which piston/piston rod assembly projects out of the housing, in which, in the cylinder space, the piston/piston rod assembly bounds a first chamber and second chamber, which chambers have a volume that depends on the position of the piston/piston rod assembly, the volume of the first chamber being at its smallest when the piston/piston rod assembly is situated in the first end position, and the volume of the second chamber being at its smallest when the piston/piston rod assembly is situated in the second end position, in which the housing is provided with a first and a second connection for the supply and discharge of hydraulic fluid, which connections are in communication with the first and the second chamber, respectively, by way of a first and a second opening, respectively, in the cylinder space, in which damping means are provided for providing a damping of the speed of movement of a piston/piston rod assembly, wherein the first opening of the second hydraulic actuator is in communication with the first opening of the first hydraulic actuator;

the second opening of the second hydraulic actuator is in communication with the second opening of the first hydraulic actuator via a third connection to the housing of the first hydraulic actuator, the third connection being in communication with the cylinder space in the first hydraulic actuator via a third opening; and the damping means are achieved by the fact that the piston/piston rod assembly of the first hydraulic actuator is provided with a throttle means, which, during movement of the piston/piston rod assembly from the first to the second end position, is designed to restrict the outflow of hydraulic fluid via the second opening before the piston/piston rod assembly reaches the second end position, in which, in addition to the first hydraulic actuator, the second hydraulic actuator is also provided with damping means which are achieved by the fact that the piston/piston rod assembly is provided with a throttle means, which is designed to restrict the outflow of hydraulic fluid via the first opening during movement of the piston/piston rod assembly from the second to the first end position before the piston/piston rod assembly reaches the first end position, and in which the first opening of the second hydraulic actuator is in communication with the first opening of the first hydraulic actuator via a third connection to the housing of the second hydraulic actuator, the third connection being in communication with the cylinder space in the second hydraulic actuator via a third opening.

2. Hydraulic actuating device according to claim 1, in which the throttle means comprises a throttle element which is fitted in an axially slidable manner on the piston rod of the first hydraulic actuator.

3. Hydraulic actuating device according to claim 1, in which the throttle means comprises a throttle element which is fitted in an axially slidable manner on the piston rod of the second actuator.

4. Hydraulic actuating device according to claim 2 in which the throttle element has a smaller diameter than the piston.

5. Hydraulic actuating device according to claim 2 in which, when the piston/piston rod assembly movement is moved from one to the other end position, the throttle element comes to lie in a restrictive manner against an opening which is in communication with the connection before the first end position has been reached.

6. Hydraulic actuating device according to claim 2 in which the throttle element is annular.

7. Hydraulic actuating device according to claim 2 in which the throttle element comprises a throttle groove on the head end.

8. Hydraulic actuating device according to claim 2 in which a spring means is provided which presses the throttle element away from the piston.

9. Vehicle, provided with a movable vehicle part which is provided with a hydraulic actuating device according to claim 1.

10. The vehicle according to claim 9 wherein the moveable vehicle part is a vehicle part for closing an opening in a vehicle body.

11. The vehicle according to claim 10 wherein the vehicle part for closing the opening in the vehicle body is a moveable roof.

12. The vehicle according to claim 11 wherein the moveable roof is at least one of a folding roof and a retractable hard top.

* * * * *